US006210055B1

(12) United States Patent
Chen et al.

(10) Patent No.: US 6,210,055 B1
(45) Date of Patent: Apr. 3, 2001

(54) METHOD AND APPARATUS FOR COCKLE REDUCTION IN PRINT MEDIA

(75) Inventors: Angela S. Chen, Portland, OR (US); Steven P. Downing, Camas, WA (US)

(73) Assignee: Hewlett-Packard Company, Palo Alto, PA (US)

( * ) Notice: Subject to any disclaimer, the term of this patent is extended or adjusted under 35 U.S.C. 154(b) by 0 days.

(21) Appl. No.: 09/535,690

(22) Filed: Mar. 27, 2000

Related U.S. Application Data

(63) Continuation of application No. 09/345,689, filed on Jun. 30, 1999, now Pat. No. 6,079,888.

(51) Int. Cl.[7] ..... B41J 2/01
(52) U.S. Cl. ..... 400/625; 347/104
(58) Field of Search ..... 347/102, 104, 347/96; 400/612, 409, 417, 419; 346/136

(56) References Cited

U.S. PATENT DOCUMENTS 3,611,407 * 10/1971 Alden ..... 346/136
4,173,314 * 11/1979 Curran et al. ..... 242/58.4
4,384,298 * 5/1983 LaBarre et al. ..... 346/129
5,140,674 * 8/1992 Anderson et al. ..... 358/1.12
5,186,107 * 2/1993 Wieland ..... 101/409
5,874,979 * 2/1999 Ohyama ..... 347/104
5,992,994 * 11/1999 Rasmussen et al. ..... 347/104
6,019,466 * 2/2000 Hermanson ..... 347/104
6,022,104 * 2/2000 Lin et al. ..... 347/102
6,079,888 * 6/2000 Chen et al. ..... 400/612

FOREIGN PATENT DOCUMENTS

0603505A1 6/1994 (EP) .

* cited by examiner

*Primary Examiner*—Eugene Eickholt

(57) ABSTRACT

The present invention addresses the problem of paper cockle by stretching the paper as it progresses along the paper path through the wet colorant printing station of a hard copy apparatus. The hard copy apparatus uses a paper feed belt system as a paper platen in which the belt or set of belts is splayed along the paper path. Firmly adhering a sheet of print media to the belt, or belts, system, such as by use of a vacuum force, as it travels through the apparatus printing zone, stretches the media orthogonally and particularly in an orientation perpendicular to the paper path.

11 Claims, 3 Drawing Sheets

METHOD AND APPARATUS FOR COCKLE REDUCTION IN PRINT MEDIA

CROSS REFERENCE TO RELATED APPLICATION(S)

This is a continuation of application Ser. No. 09/345,689 filed on Jun. 30, 1999 now U.S. Pat. No. 6,079,882.

BACKGROUND OF THE INVENTION

1. Field of the Invention

The present invention relates generally to hard copy methods and apparatus, more particularly to print media handling and, more specifically to a print media transport belt used in a wet colorant printing apparatus such as an ink-jet printer.

2. Description of Related Art

For convenience of explanation, while the present invention is useful for all wet colorant hard copy apparatus, it is described with respect to an ink-jet printer. The use of this exemplary embodiment is not intended as a limitation on the scope of the invention nor should any such intention be implied as the invention can be adapted to implementations using other wet colorant printing techniques, e.g., pigment-based and dye-based inks used in ink-jet printing, Wet toner laser printing systems, and the like, also synonymously referred to hereinafter as a "wet dye" printing; the terms "colorant" or "dye" shall be construed to encompass both color and black and grey scale wet printing techniques.

The art of the exemplary embodiment in ink-jet technology is relatively well developed. Commercial products such as computer printers, graphics plotters, copiers, and facsimile machines employ ink-jet technology for producing hard copy. The basics of this technology are disclosed, for example, in various articles in the assignee's *Packard Journal*, Vol. 36, No. 5 (May 1985), Vol. 39, No. 4 (August 1988), Vol. 39, No. 5 (October 1988), Vol. 43, No, 4 (August 1992), Vol. 43, No. 6 (December 1992) and Vol. 45, No.1 (February 1994) editions, incorporated herein by reference for general background. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988). Further details to facilitate an understanding of the present invention are provided below with respect to FIG. 1. For convenience of description, print media of all shapes, sizes, and varieties are referred to hereinafter simply as "paper."

A well-known phenomenon of wet-colorant printing is "paper cockle," the irregular surface produced in paper by the saturation and drying of ink deposits on the fibrous medium. As a sheet of paper gets saturated with ink, the paper grows and buckles in a seemingly random manner. Paper printed with images are more saturated with colorant than simple text pages and thus exhibit great paper cockle. Colors formed by mixing combinations of other color ink drops form greater localized saturation areas and also exhibit greater cockle tendencies.

In general, the prior art has approached the problem by using ribs that support the sheet of paper at various points along the width. In the state of the art, ink-jet printhead to paper separation is only about 0.5 to 1.5 millimeters. These ribbed paper support constructs allow any cockle growth to grow down away from the printing mechanism instead of toward it where contact could occur and cause further problems. Moreover, the use of ribbed paper support constructs alone is not adequate for larger dimensioned print zones. In order to hold print media flat under larger printheads a different holddown is required, such as a vacuum platen.

It has been discovered that media fiber directionality has a significant influence on the directionality of cockle growth. Papers generally have a grain in one direction longer than the other. Rib support constructs may thus be inadequate, depending on the nature of the media being printed. Feeding a sheet into a printing station of the hard copy apparatus with an orientation that minimizes cockle is impractical since it would limit the end-user's ability to select different media types.

There is a need for a paper transport and printing station paper holding device to substantially reduce and for practical purposes substantially eliminate problematical paper cockle.

SUMMARY OF THE INVENTION

In its basic aspects, the present invention provides a wet colorant hard copy device for reducing print media cockle. The device includes a belt mechanism for transporting print media through a wet colorant printing zone. The print media has a first surface and a second surface. The print media first surface adheres to at least one belt of the belt mechanism during transport. The print media is maintained in a substantially planar orientation on the belt mechanism at least through the printing zone such that the wet colorant is deposited on the print media second surface. The belt mechanism is splayed from a first cross dimension perpendicular to direction of travel of the print media as the print media enters the printing zone to a second cross dimension perpendicular to direction of travel of the print media as the print media exits the printing zone. The second dimension is greater than the first dimension. The belt mechanism includes at least one belt having a belt surface of a material for contacting the first surface wherein the belt surface has a coefficient of friction sufficient for gripping the first surface for applying lateral forces thereon or mechanisms for exerting a vacuum force on the first surface, or both.

In another basic aspect, the present invention provides a method for compensating for paper cockle in a wet colorant hard copy apparatus having a printing zone. The method includes the steps of: transporting a sheet of paper in a substantially planar orientation along a paper path through the printing zone, and gradually stretching the sheet of paper perpendicularly to the paper path from at least a point of entry of the printing zone in the paper path to at least a point of exit of the sheet from the printing zone in the paper path. The stretching includes stretching the sheet of paper at least over a distance greater than a paper path length of the printing zone when the ink dry time so requires.

In another basic aspect, the present invention provides an ink-jet hard copy apparatus for print media, including: an ink-jet printing mechanism for depositing wet colorant on the print media; and, mounted in the printer in relationship to the printing mechanism, a belt mechanism for sequentially transporting sheets of print media through a printing zone of the apparatus such that the print media has a first surface that adheres to at least one belt of the belt mechanism during the transporting and the print media is maintained in a substantially planar orientation on the belt at least through the printing zone such that the wet colorant is deposited on a print media second surface by the printing mechanism and wherein the belt is splayed from a first cross dimension perpendicular to direction of travel of the print media as the print media enters the printing zone to a second cross dimension perpendicular to direction of travel of the print media as the print media to at least a position wherein the print media exits the printing zone wherein the second dimension is greater than the first dimension.

It is an advantage of the present invention that it allows paper to grow due to wet colorant saturation, yet keeps the paper substantially flat.

It is an advantage of the present invention that it combines the functions of a paper transport and a paper platen.

It is another advantage of the present invention that it compensates for paper cockle regardless of print media fiber orientation.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

The present invention approaches the problem of paper cockle by stretching the paper as it progresses along the paper path through the wet colorant printing station of a hard copy apparatus.

Figure 1:
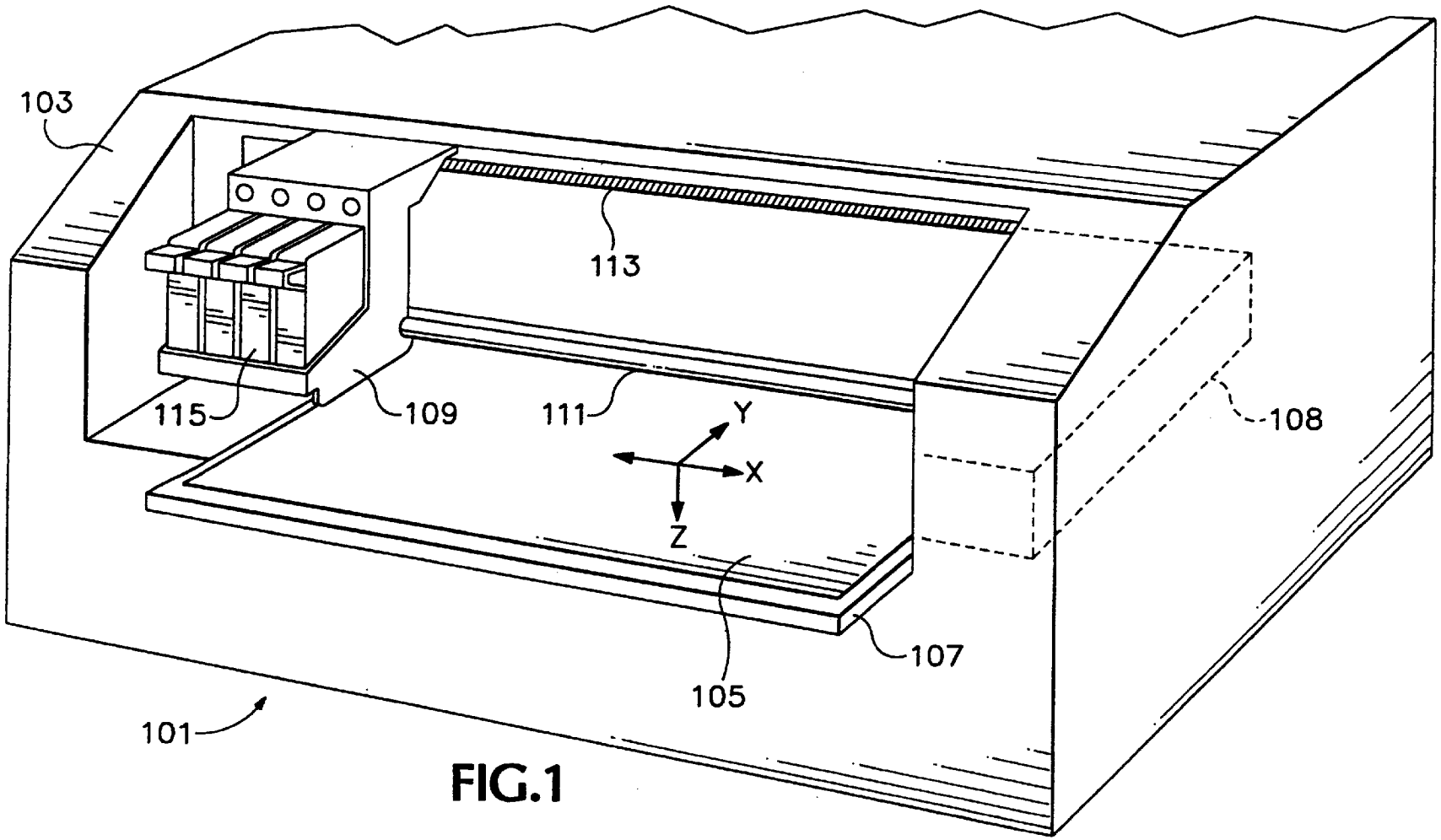
FIG. 1 is an ink-jet hard copy apparatus in accordance with the present invention.

FIG. 1 depicts an ink-jet hard copy apparatus; in this exemplary embodiment, a computer peripheral printer 101 is shown. A housing 103 encloses the electrical and mechanical operating mechanisms of the printer 101. Operation is administrated by an electronic controller (usually a microprocessor or application specific integrated circuit ("ASIC"), not shown) connected by appropriate cabling to a computer (not shown). It is well known to program and execute imaging, printing, print media handling, control functions and logic with firmware or software instructions for conventional or general purpose microprocessors or with ASIC's; further explanation is not necessary to an understanding of the present invention. Cut-sheet print media 105, loaded by the end-user onto an input tray 107, is fed by a paper-path transport 108 in accordance with the present invention to an internal printing station, or "print zone," where graphical images and alphanumeric text is created. A carriage 109, mounted on a slider 111, scans the fed print medium 105. An encoder 113 is provided for keeping track of the position of the carriage 109 at any given time. One or more individual ink-jet pens, or print cartridges, 115 are releasable mounted in the carriage 109 for easy access (generally, in a full color system, inks for the subtractive primary colors, cyan, yellow, magenta (CYM) and true black (K) are provided). Once a printed page is completed, the print medium is ejected, such as onto an output tray (not shown) or the desktop. As depicted by the labeled arrows in FIG. 1, it is common in the art to refer to the pen scanning direction as the x-axis, the paper feed direction as the y-axis, and the ink drop firing direction as the z-axis.

Figure 2:
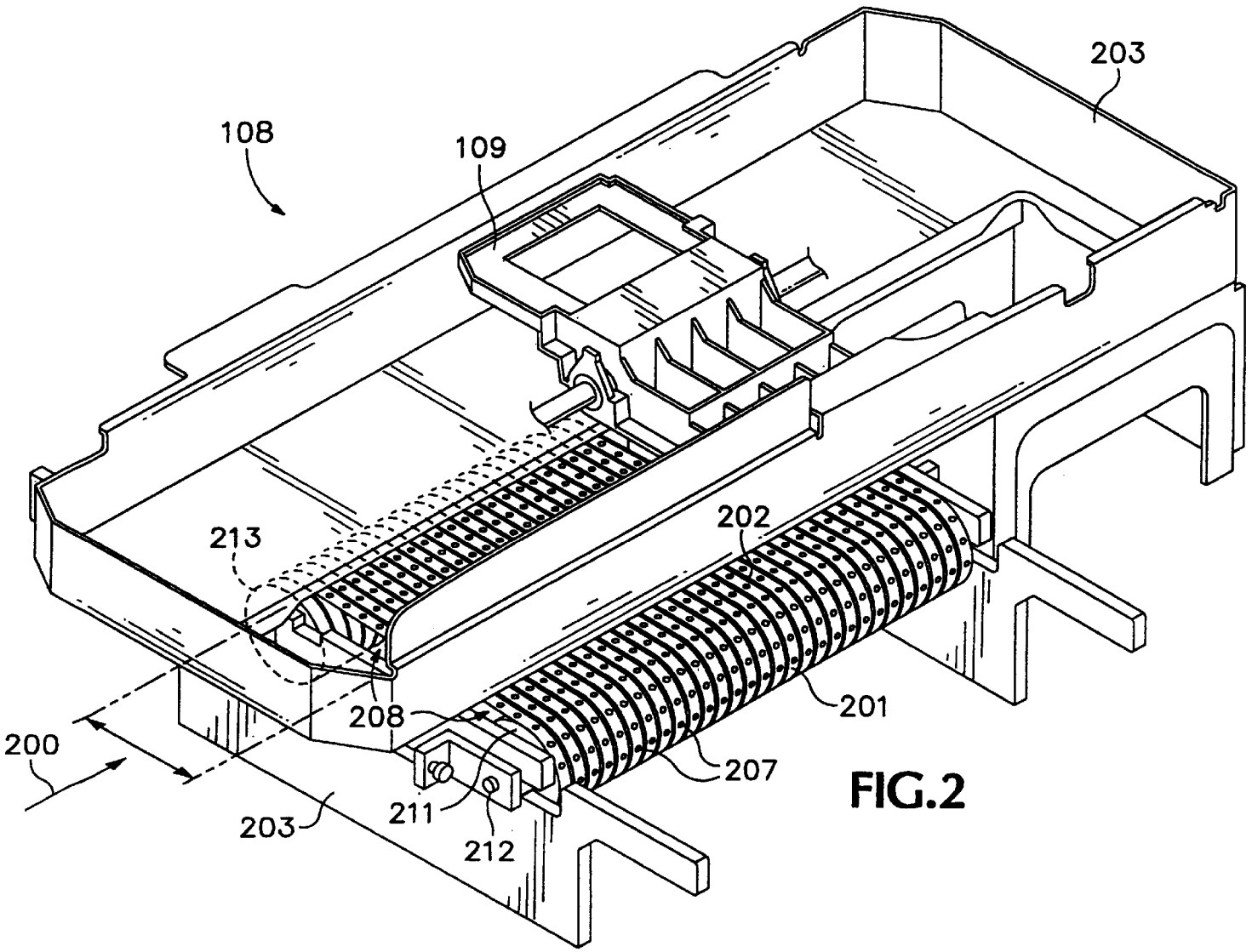
FIG. 2 is a perspective view of the vacuum transport device in accordance with the present invention as shown in FIG. 1.

FIG. 2 shows a belt-drive, paper-path transport 108 in accordance with the present invention. Either a single, flexible, paper-path transport belt or, as shown in this exemplary embodiment, a plurality of individual flexible belts, 201 is adapted to act also as a paper platen in the x-y axes print zone (generally indicated by the labeled arrow 200) adjacent the scanning carriage 109. A chassis 203 provides suitable, known manner, mounting for the components of the transport 108 and the pen carriage 109 relative to the print zone 200 in accordance with the needs of a specific design implementation as would be known to persons skilled in the art.

The belts 201 are mounted and stretched tautly between front, grooved rim, pulleys 211 and rear, grooved rim, pulleys 213. (It should be recognized that many paper path configurations—e.g., front or back or top or bottom paper feed, a single, multi-grooved, pulley wheel or a set of individual pulleys, and the like can be implemented; therefore, the terms like "front" and "rear" used to describe the invention relative to the exemplary embodiments depicted in the FIGURES and not a limitation on the invention itself.) In an implementation using a plurality of belts 201, the belts' outer surface should be higher than the rims at least at the paper path's entrance side. The pulleys 211, 213 are mounted in a known manner to the frame 203 for rotation about a respective front pulley axle 212 and a rear pulley axle (not seen in this view). One of the axles 212 is driven by a motor (not shown) in any known manner of the state of the art. The pulley rims 202 keep the belts 201 in a substantially parallel alignment as explained further hereinafter. Belts composed of a flexible material such as rubber or other material with a sufficiently high coefficient of -friction as would be known in the art can be employed in accordance with the present invention. Note that the belts 201 may be alternatively supported by a subjacent, flexible belt-support layer 301 where, turning also to FIG. 3, a gap 209 between adjacent belts is wide enough such that having vacuum ports 207' through belt-support layer 301 aligned with each gap provides sufficient vacuum force to adhere the paper firmly to the belts. The ports have a diameter in the range of approximately 0.4 to 1.5 millimeters; however, this size may vary significantly depending on the actual implementation design and will be function of many factors—vacuum pressure, print zone dimensions, and the like as would be known to a person skilled in the art. This configuration may also provide a firmer platen-side surface where the media size is large and the belt dimensions are relatively long in the paper path direction.

The functional operation of the belt system 109 is to receive a sheet of paper 105 (FIG. 1) from a known manner paper pick-and-feed mechanism (not shown) associated with the input tray 107, to move the sheet through the print zone 200 of the hard copy apparatus 101 where the carriage 109 selectively positions the pens 115 with respect to the paper while a printing algorithm fires the pen printheads appropriately to create text and images, and then to eject the printed page from the print zone.

Paper transport using a belt drive has many known advantages. A vacuum belt performs extremely well, particularly at holding a sheet of paper substantially planar at the hard copy apparatus printing station. Thus, in the preferred embodiment, the transport 108 comprises a vacuum belt system. Each belt 201 includes a plurality of vacuum ports 207. A vacuum force in a vacuum chamber 208 formed by the belts 201 is conventionally generated, such as with an appropriately configured exhaust fan (not shown) mounted within the chassis 203 such that the vacuum force is applied to the inner surface, or "vacuum-side surface," of the belts 201. The vacuum force is transmitted to the outer surface, or "platen-side surface," of the belts 201 via each vacuum port 207 or via the gaps 209 between adjacent belts, or both. A cut sheet print media picked and fed from the input tray 107 (FIG. 1) to the belts 201 thus adheres firmly to the belts 201. Moreover, if individual belts are relatively long in the y-axis, the addition of ribs can be made to assist in guidance.

Figure 3:
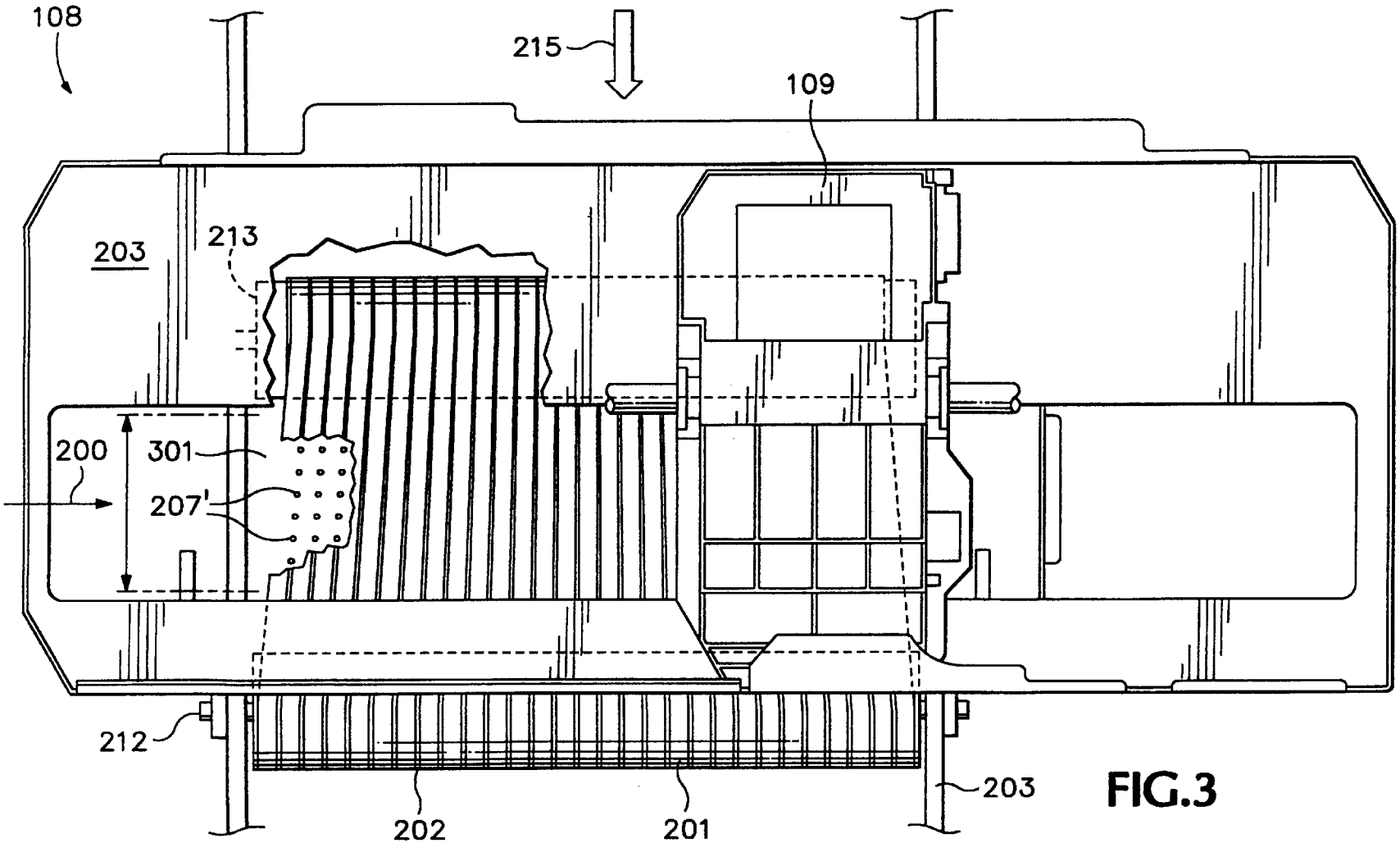
FIG. 3 is a plan view (top) of a vacuum transport device for the ink-jet hard copy apparatus as shown in FIG. 2.

Looking now to both FIGS. 2 and 3, the belts 201 are intentionally splayed from the paper feed entrance to the paper feed exit of the print zone 200. This paper feed relative direction is depicted as arrow 215 in FIG. 3, With a sheet of paper adhered to the belts 201, the splayed belt drive keeps and increases tension across the paper in the x-axis (FIG. 1) as the paper moves in the y-axis through the print zone 200 and exits the transport 108. For an A-size paper printer using a vacuum force pressure against the bottom of the paper sheet in the range of five to twenty inches-water-column ("W.C." hereinafter), it has been found that a front-to-rear (or entrance-to-exit) splay of approximately one-half inch is sufficient to keep tension across the page and hold the page flat against the platen. Again, these specifications relate only to the exemplary embodiment; the actual optimum splay will be a function of the specific implementation design.

In still another alternative embodiment, a single flexible belt having vacuum ports therethrough and spanning the print zone and may be employed provided it meets the requirement for media entrance to media exit splay.

As the wet colorant may require a predetermined dry time, depending on factors such as ink composition, paper composition, ambient temperature, and the like as would be known to a person skilled in the art, it is advantageous to continue stretching the paper as it dries. Thus, as shown, the belts 201 continue to splay as the leading edge of the paper moves out of the print zone and toward paper ejection.

The foregoing description of the preferred embodiment of is the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, a lateral edge paper holder that stretches the paper as it moves along the paper path can also be employed in accordance with the methodology described herein. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so state, but rather means "one or more." No element, component, nor method step in the present disclosure is intended to be dedicated to the public regardless of whether the element, component, or method step is explicitly recited in the claims. No claim element herein is to be construed under the provisions of 35 U.S.C. Sec. 112, sixth paragraph, unless the element is expressly recited using the phrase "means for . . . ."

What is claimed is:

1. A method for compensating for paper cockle in an ink-jet hard copy apparatus having a printing zone, the method comprising the steps of:

transporting a sheet of paper along a paper path through the printing zone, and gradually stretching the sheet of paper at least perpendicularly to the paper path.

2. The method as set forth in claim 1, wherein the step of stretching comprises the step of:

stretching the sheet of paper at least over a distance greater than a paper path length of the printing zone.

3. The method as set forth in claim 1, comprising the steps of:

providing the printing zone with a paper path entrance and an paper path exit, transporting print media sheets sequentially through the printing zone on a flexible belt to which the media is temporarily adhered from at least the entrance through the printing zone to the exit; and splaying the flexible belt as the belt moves from the entrance through the zone to at least the exit such that media adhered to the belt is stretched at least an amount wherein cockle resultant from wet colorant deposited on the media in the printing zone is compensated such that the media remains substantially planar.

4. The method as set forth in claim 3, the step of transporting further comprising the step of:

adhering the sheets to the belt by a vacuum force.

5. The method as set forth in claim 3, the step of transporting further comprising the step of:

adhering the sheets to the belt by a friction force.

6. A method for compensating for paper cockle in a wet colorant printer, comprising the steps of:

feeding a sheet into a printing zone in a first direction;

depositing wet colorant on the sheet;

at least downstream of said printing zone, stretching the sheet at least transversely to the first direction; and stretching the sheet such that said sheet is stretched greater than a first direction length of the printing zone in the first direction.

7. The method as set forth in claim 6, the step of stretching comprising:

stretching the sheet at regions thereof as wet colorant is deposited thereon.

8. The method as set forth in claim 6, the step of stretching comprising:

stretching the sheet starting in the printing zone.

9. An ink-jet print media transport device for reducing cockle comprising:

belt means for transporting media through a printing zone wherein said belt means spreads downstream of the printing zone; and means for adhering the media to the belt means such that distension of the media is induced while the media is wet.

10. The device as set forth in claim 9, comprising:

said belt means includes a plurality of belts that are splayed at least downstream of the printing zone.

11. The device as set forth in claim 10, comprising:

the belts are splayed from an input side of the printing zone to an output side of the printing zone.

* * * * *